US005503141A

United States Patent [19]

Kettl et al.

[11] Patent Number: 5,503,141

[45] Date of Patent: Apr. 2, 1996

[54] MICROPHONE MOUNTING STRUCTURE FOR A SOUND AMPLIFYING RESPIRATOR

[76] Inventors: Lonnie J. Kettl, 1173 Cordoba Dr., Zachary, La. 70791; James C. Mikronis, 7723 S. Maribel, Baton Rouge, La. 70812

[21] Appl. No.: 372,330

[22] Filed: Jan. 13, 1995

[51] Int. Cl.[6] ..... A62B 18/08

[52] U.S. Cl. ..... 128/201.19; 128/206.16; 128/206.17; 381/169

[58] Field of Search ..... 128/201.19, 206.16, 128/206.17; 381/169

[56] References Cited

U.S. PATENT DOCUMENTS

| | | | |
|---|---|---|---|
| 2,950,360 | 10/1960 | Duncan | 179/146 |
| 2,953,129 | 9/1960 | Bloom et al. | 128/146 |
| 3,180,333 | 4/1965 | Lewis | 128/141 |
| 3,314,424 | 4/1967 | Berman | 128/142.4 |
| 4,072,831 | 2/1978 | Joscelyn | 179/188 |
| 4,116,237 | 9/1978 | Birch | 128/142.7 |
| 4,491,699 | 1/1985 | Walker | 179/156 R |
| 4,508,936 | 4/1985 | Ingalls | 179/82 |
| 4,537,276 | 8/1985 | Confer | 181/21 |
| 4,885,796 | 12/1989 | Loftus et al. | 381/169 |
| 4,980,926 | 12/1990 | Noetzel | 128/201.19 |
| 5,060,308 | 10/1991 | Bieback | 359/184 |
| 5,138,666 | 8/1992 | Bauer et al. | 381/169 |
| 5,159,641 | 10/1992 | Sopko et al. | 381/169 |
| 5,224,473 | 7/1993 | Bloomfield | 128/201.19 |
| 5,307,793 | 5/1994 | Sinclair et al. | 128/201.19 |
| 5,428,688 | 6/1995 | Becker et al. | 381/169 |

*Primary Examiner*—Edgar S. Burr
*Assistant Examiner*—William J. Deane, Jr.
*Attorney, Agent, or Firm*—Jacobson, Price, Holman & Stern

[57] ABSTRACT

A microphone mounting structure for mounting a microphone to a respiratory mask through a hole in the respiratory mask. The microphone mounting structure is thus able to convert a conventional respiratory mask into a sound amplifying respiratory mask. The microphone mounting structure comprises a tubular plug, a sleeve, and a tubular locking mechanism. The tubular plug has a closed end, an open end and a central portion disposed therebetween. The closed end of the tubular plug has a larger outer diameter than an outer diameter of the central portion. The open end has a plurality of resilient fingers defined by slots in the open end, the resilient fingers having finger tips which project radially outwardly with respect to the tubular plug. The sleeve receives the microphone and is dimensioned so as to fit coaxially inside the tubular plug. The tubular locking mechanism has an inner diameter substantially equal to the outer diameter of the central portion and a longitudinal length slightly shorter than a combination of the central portion and the open end. Accordingly, the tubular locking mechanism is slidable over the resilient fingers after the tubular plug is inserted through the hole in the mask. This forces the resilient fingers radially inwardly until the entire tubular locking mechanism has passed over the fingers tips of the resilient fingers at which time the finger tips snap radially outwardly to thereby lock the microphone mounting structure to the respiratory mask. Amplification circuitry is also provided.

20 Claims, 3 Drawing Sheets

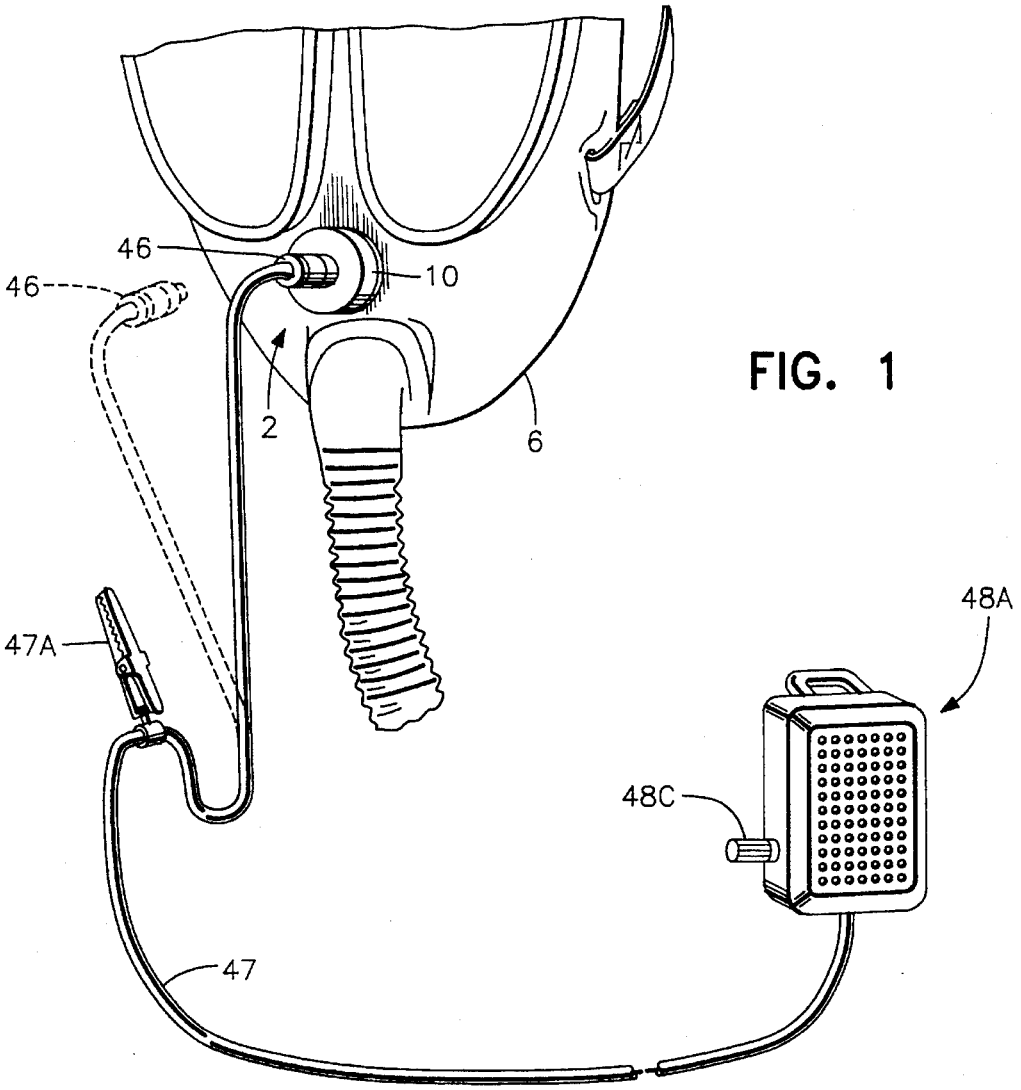
FIG. 1
FIG. 5
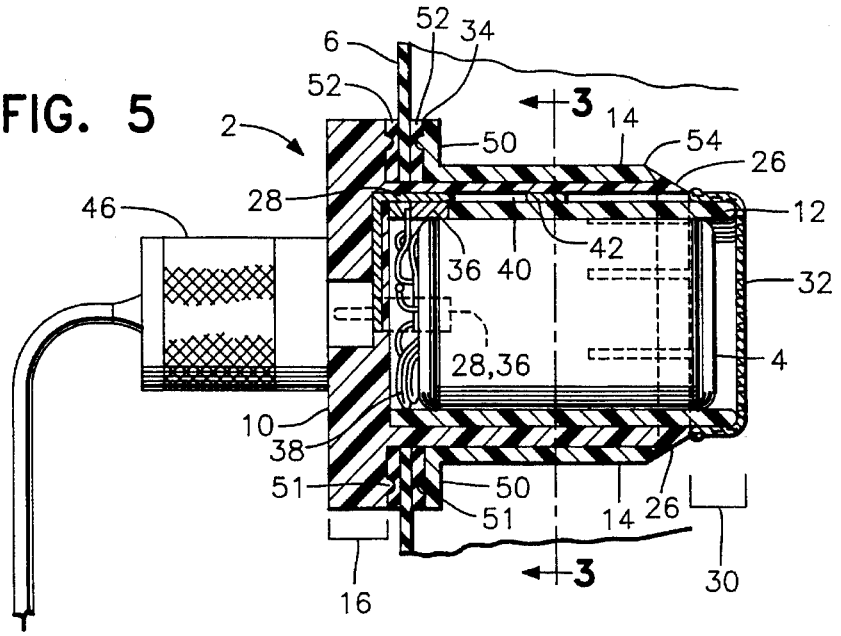

MICROPHONE MOUNTING STRUCTURE FOR A SOUND AMPLIFYING RESPIRATOR

BACKGROUND OF THE INVENTION

The present invention relates to a microphone mounting structure, and in particular, a microphone mounting structure which permits easy and reliable conversion of a conventional respirator to a sound amplifying respirator.

It is known that conventional respirators make communications difficult between persons wearing the respirators. In particular, the wearer's voice is muffled and difficult to detect over significant distances. This problem is exacerbated when there is background noise, as during firefighting and other similarly hazardous emergency operations. In response to this problem, several attempts have been made to provide sound amplifying respirators and/or masks which facilitate communications among the wearers of the respirators and masks. Examples of such respirators and masks are illustrated by the following U.S. Patents:

| U.S. Pat. No. | PATENTEE |
|---|---|
| 5,307,793 | Sinclair et al. |
| 5,224,473 | Bloomfield |
| 5,159,641 | Sopko et al. |
| 5,138,666 | Bauer et al. |
| 5,060,308 | Bieback |
| 4,537,276 | Confer |
| 4,508,936 | Ingalls |
| 4,491,699 | Walker |
| 4,116,237 | Birch |
| 4,072,831 | Joscelyn |
| 3,314,424 | Berman |
| 3,180,333 | Lewis |
| 2,953,129 | Bloom et al. |
| 2,950,360 | Duncan |

Although the above exemplary respirators and masks are generally effective, there are several disadvantages associated therewith. The Joscelyn patent, for example, teaches a mounting structure for the microphone which is integrally formed with the mask. Thus, retro-fitting of existing masks with the arrangement of Joscelyn would be very difficult and time-consuming.

Still other disadvantages are associated with one or several ones of the above exemplary respirators and masks. These disadvantages include significant reductions in amplification quality resulting in distortion of the amplified voice; the need for expensive and excessively complex circuitry or manufacturing techniques; serious distortion if the mask is frequently bumped or otherwise subject to frequent quick movements; incompatibility with some irregularly shaped masks and smaller masks, such as filter masks; mounting of the microphone assembly to the mask using a threaded connection which may become loosened during extended use, such loosening of the threaded connection possibly compromising the air-tightness of the mask and thereby posing an extreme danger to the user of the masks in hazardous environments; and difficulty in removing the microphone temporarily from the mask for purposes of cleaning the mask.

SUMMARY OF THE INVENTION

It is a primary object of the present invention to overcome the deficiencies of the prior art by providing a microphone mounting structure which permits easy and reliable conversion of a conventional respirator into a sound amplifying respirator.

Another object of the present invention is to provide a small, light-weight microphone mounting structure which is compatible with almost any respirator mask, including paper filter masks, and positively locks thereto to prevent inadvertent loosening of the mounting structure or leakage through the mask.

Yet another object of the present invention is to provide a microphone mounting structure which does not require a pre-existing mounting feature or connector on the respirator mask, and instead breaches the mask and then re-establishes the air-tight characteristics of the mask.

Still another object of the present invention is to provide a microphone mounting structure which does not require complex or expensive circuitry, nor does it require complex signal transmission means such as infra-red transmitters and receivers.

A further object of the present invention is to provide a microphone mounting structure which provides direct electrical connections between a microphone inside a respirator mask, and amplifying circuitry so as to provide enhanced voice signal quality.

Another object of the present invention is to provide a microphone mounting structure with an amplification circuit that provides maximum voice signal quality for voices detected within the mask by the microphone.

To achieve these and other objects, the present invention comprises a microphone mounting structure for mounting a microphone to a respiratory mask through a hole in the respiratory mask. The microphone mounting structure is thus able to convert virtually any conventional respiratory mask into a sound amplifying respiratory mask.

The microphone mounting structure comprises a tubular plug, a sleeve, and a tubular locking mechanism. The tubular plug has a closed end, an open end and a central portion disposed therebetween. The closed end of the tubular plug has a larger outer diameter than the outer diameter of the central portion. The open end has a plurality of resilient fingers defined by slots in the open end, the resilient fingers having finger tips which project radially out with respect to the tubular plug. The tubular plug further comprises electrical contact means for electrically connecting an interior of the tubular plug with an exterior of the tubular plug.

The sleeve receives the microphone and has an outer diameter substantially equal to the inner diameter of the tubular plug so that the sleeve fits coaxially inside the tubular plug. Preferably, the sleeve has an internal diameter which matches the outer diameter of the microphone so that the microphone is frictionally retained within the sleeve. The sleeve, however, is preferably longer than the central portion and open end of the tubular plug. In this way, a portion of the sleeve projects out from the tubular plug and this, in turn, facilitate removal of the sleeve from within the tubular plug using, for example, needle-nosed pliers.

A microphone cover may also be provided which fits snugly over the projecting sleeve portion and protects the microphone from moisture, dust, and the like. The microphone cover is preferably arranged only over the projecting sleeve portion so that the resilient fingers of the tubular plug remain exposed for easy inspection.

The tubular locking mechanism cooperates with the tubular plug to lock the microphone mounting structure to the respiratory mask. In particular, the tubular locking mechanism includes an inner diameter substantially equal to the outer diameter of the central portion and a longitudinal length only slightly shorter than the combination of the central portion and the open end. By providing these dimensions, the tubular locking mechanism is slidable over the resilient fingers after the tubular plug has been inserted through the hole in the respiratory mask. Doing so, in turn, forces the resilient fingers radially inwardly until the entire tubular locking mechanism has passed over the fingers tips of the resilient fingers, at which time the finger tips snap radially outwardly to thereby lock the microphone mounting structure to the respiratory mask. The respiratory mask, consequently, remains sandwiched and locked between the front end of the tubular locking mechanism and the closed end of the tubular plug.

The microphone mounting structure of the present invention preferably comprises three electrical contacts extending radially through the sleeve and arranged for electrical connection to the electrical contact means in the tubular plug. In addition, three electrical wires are provided for electrically connecting the electrical contacts to the microphone.

The microphone mounting structure preferably also comprises an internal alignment slot extending longitudinally along the central portion and open end of the tubular plug, and an external alignment tab which projects radially out from the sleeve for alignment with the internal alignment slot of the tubular plug. The alignment slot and tab are arranged such that, whenever the external alignment tab is received in the internal alignment slot, the external alignment tab prevents axial rotation of the sleeve with respect to the tubular plug. This arrangement helps keep the three electrical contacts of the sleeve aligned with the electrical contact means of the tubular plug.

Preferably, a socket is also provided at the closed end of the tubular plug. The socket receives an electrical plug which electrically connects the electrical contact means to an amplification circuit.

The microphone mounting structure can further comprise a circumferential flange projecting radially outwardly from the front end of the tubular locking mechanism. At least one resilient washer is preferably disposed coaxially around the central portion of the tubular plug, between the front end of the tubular locking mechanism and the closed end of the tubular plug.

According to a preferred arrangement, at least one and preferably all of the finger tips project radially outwardly and backwardly toward the central portion so that each of the corresponding resilient fingers has a semi-arrow-shaped distal end. In addition, the tubular locking mechanism includes an externally bevelled back end for lockingly engaging the semi-arrow-shaped distal end of the resilient fingers.

Amplification circuitry provides output sounds representative of the oral sounds which the microphone detects within the mask. The amplification circuitry may be provided entirely in a separate housing, or alternatively, may be manufactured using integrated chip technology so that certain circuit components are miniaturized and built into the closed end of the tubular plug. According to the latter arrangement, a speaker and power supply portions of the amplification circuitry would remain in a separate housing.

For purposes of this disclosure, the term "respiratory mask" is intended to broadly encompass all types of respiratory masks, including those attached to a supply of gas and those which merely filter air, including conventional paper filter masks.

The above and other objects and advantages will become more readily apparent when reference is made to the following description taken in conjunction with the accompanying drawings.

BRIEF DESCRIPTION OF THE DRAWINGS

FIG. 1 is a perspective view of a microphone mounting structure disposed on a respirator mask and connected to an amplification circuit in accordance with the present invention.

FIG. 5 is a side cross sectional view of the microphone mounting structure illustrated in FIGS. 1–4.

DETAILED DESCRIPTION OF THE PREFERRED EMBODIMENTS

Figure 2:
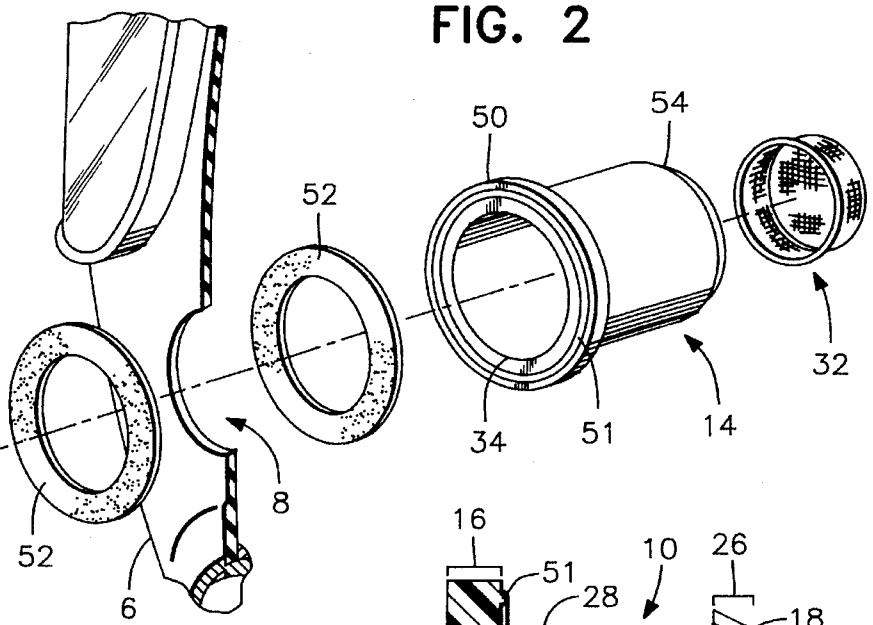
FIG. 2 is an exploded view of the microphone mounting structure illustrated in FIG. 1.
Figure 3:
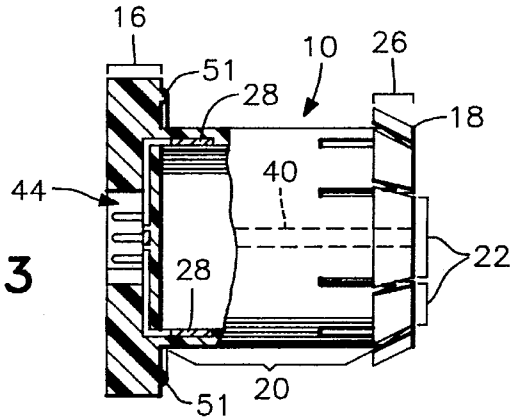
FIG. 3 is a top partially cross sectioned view of a tubular plug in accordance with the present invention.
Figure 4:
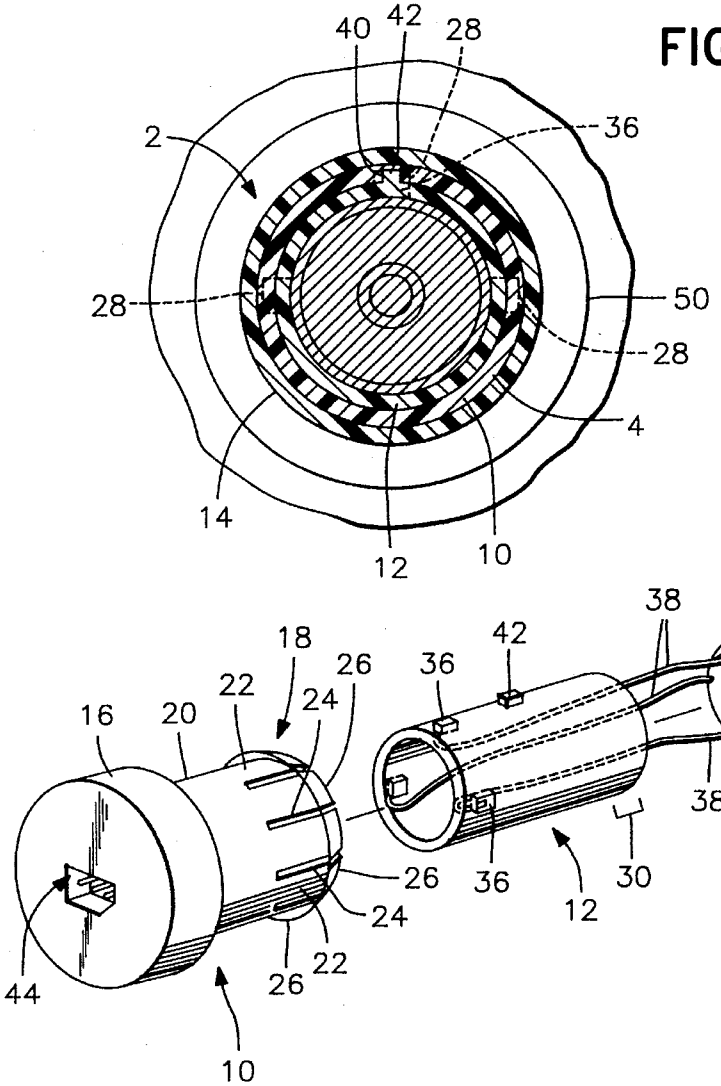
FIG. 4 is a cross section of the microphone mounting structure in accordance with the present invention.

The preferred embodiments of the present invention will now be described with reference to FIGS. 1–6.

According to the preferred embodiments, a microphone mounting structure 2 is provided for mounting a microphone 4 to a respiratory mask 6. All that is required to effect mounting of the mounting structure 2 to the respiratory mask 6 is a hole 8 in the respiratory mask 6. Such a hole 8 can be easily cut or drilled through an existing conventional respiratory mask at any convenient location in the mask 6. It is preferably mounted in the front near the wearer's mouth. Accordingly, the microphone mounting structure 2 is able to convert virtually any conventional respiratory mask into a sound amplifying respiratory mask 6.

The microphone mounting structure 2 comprises a tubular plug 10, a sleeve 12, and a tubular locking mechanism 14. The tubular plug 10, sleeve 12, and tubular locking mechanism 14 are all made from non-conductive material, preferably a moldable plastic such as ZYTEL which is a commercially available high-temperature nylon thermoplastic resin manufactured by DuPont. The tubular plug 10 has a closed end 16, an open end 18 and a central portion 20 disposed therebetween. The closed end 16 of the tubular plug 10 has a larger outer diameter than the outer diameter of the central portion 20. The open end 18 has a plurality of resilient fingers 22 defined by slots 24 in the open end 18, the resilient fingers 22 having finger tips 26 which project radially outwardly with respect to the tubular plug 10. The tubular plug 10 further includes electrical contact means 28 for electrically connecting the interior of the tubular plug 10 with the exterior of the tubular plug 10.

The sleeve 12 has an outer diameter substantially equal to the inner diameter of the tubular plug 10 so that the sleeve 12 fits coaxially inside the tubular plug 10. These dimensions preferably provide frictional retention of the sleeve 12 inside the tubular plug 10.

In addition, the sleeve 12 preferably has an internal diameter which matches the outer diameter of the microphone 4 so that the microphone 4 remains frictionally retained within the sleeve 12. The sleeve 12 is preferably longer than the combination of the central portion 20 and open end 18 in the tubular plug 10. In this way, portion 30 of the sleeve 12 projects out from the tubular plug 10 and this, in turn, facilitate removal of the sleeve 12 from within the tubular plug 10 using, for example, needle-nosed pliers.

A microphone cover 32 may also be provided which fits snugly over the projecting sleeve portion 30 and protects the microphone 4 from moisture, dust, and the like. The microphone cover 32 is preferably arranged only over the projecting sleeve portion 30 so that the resilient fingers 22 of the tubular plug 10 remain exposed for easy inspection. According to a preferred embodiment, the microphone cover 32 is made using water-impermeable high density cloth or water-impermeable tightly woven cloth.

The tubular locking mechanism 14 cooperates with the tubular plug 10 to lock the microphone mounting structure 2 to the respiratory mask 6. In particular, the tubular locking mechanism 14 includes an inner diameter substantially equal to the outer diameter of the central portion 20 and a longitudinal length only slightly shorter than the combination of the central portion 20 and the open end 18. By providing these dimensions, the tubular locking mechanism 14 is slidable over the resilient fingers 22 after the tubular plug 10 has been inserted through the hole 8 in the respiratory mask 6. Doing so, in turn, forces the resilient fingers 22 radially inwardly until the entire tubular locking mechanism 14 has passed over the fingers tips 26 of the resilient fingers 22, at which time the finger tips 26 snap radially outwardly to thereby lock the microphone mounting structure 2 to the respiratory mask 6. The respiratory mask 6, consequently, remains sandwiched and locked between a front end 34 of the tubular locking mechanism 14 and the closed end 16 of the tubular plug 10.

The sleeve 12 preferably includes three electrical contacts 36 extending radially through the sleeve 12 and arranged for electrical connection to the electrical contact means 28 in the tubular plug 10. Preferably, frictional retention of the sleeve 12 within the tubular plug 10 is enhanced by the friction which exists between the three electrical contacts 36 in the sleeve 12 and the contact means 28 of the tubular plug 10. In addition, three electrical wires 38 are provided for electrically connecting the three electrical contacts 36 to the microphone 4 in any convenient, known manner.

The microphone 4 is preferably a commercially available ELECTRECT condenser microphone, sold commercially by Panasonic. The microphone 4 is responsive to oral sounds within the respiratory mask 6, and produces electrical signals indicative of these oral sounds. The microphone 4 is electrically connected to electrical contact means 28 using the three wires 38 so that these electrical signals will be provided to the contact means 28.

The microphone mounting structure 2 also preferably includes an internal alignment slot 40 extending longitudinally along the inner surface of central portion 20 and open end 18 of the tubular plug 10, and an external alignment tab 42 which projects radially outwardly from the sleeve 12 for alignment with the internal alignment slot 40 of the tubular plug 10. The alignment slot 40 and tab 42 are arranged such that, whenever the external alignment tab 42 is received in the internal alignment slot 40, the external alignment tab 42 prevents axial rotation of the sleeve 12 with respect to the tubular plug 10. This arrangement advantageously helps keep the three electrical contacts 36 of the sleeve 12 aligned with the electrical contact means 28 of the tubular plug 10.

Preferably, a socket 44 is provided at the closed end 16 of the tubular plug 10. The socket 44 receives an electrical plug 46 which, in combination with an electrical cable 47, electrically connects the electrical contact means 28 to an amplification circuit 48 shown schematically in FIG. 6. The electrical cable 47 may include an alligator clip 47A which engages an article of clothing to support the weight of the cable 47. This arrangement would be helpful in preventing inadvertent disconnection of the plug 46 from the socket 44 and stress failure of the connection between the cable 47 and the plug 46. In addition, the electrical cable 47 preferably consists of a commercially available, shielded electrical cable to thereby prevent the pick-up of a static hum on the cable 47.

According to a preferred use of the present invention, the separate housing 48A is secured to a shoulder of a user's clothing to thereby facilitate communications using a telephone, radio, or intercom system, any one or all of which may be found in nuclear and other industrial plants. Clear concise communications will increase wearer or user safety and, in groups, will add synergy and reduce work time in hazardous environments, thereby reducing exposure to such hazardous environments.

The amplification circuit 48 provides output sounds representative of the oral sounds which the microphone 4 detects within the mask 6. The amplification circuit 48 may be disposed entirely in a separate housing 48A, or alternatively, may be manufactured using integrated chip technology so that certain circuit components are miniaturized and built into the closed end 16 of the tubular plug 10. According to the latter arrangement, a speaker U3 and power supply portion 48B of the amplification circuit 48 would remain in the separate housing 48A, primarily due to their size.

The separate housing 48A can include an ON/OFF and volume control knob 48C, as is generally known, for turning the amplification circuit 48 on and off and for controlling gain in the amplification circuit to thereby effect volume control. The separate housing 48A also includes a battery compartment, as is generally known, for removably storing batteries which power the amplification circuit 48. The knob 48C and battery compartment each include gaskets which maintain an air-tight seal between the interior and exterior of the separate housing 48A. Preferably, any element which breeches the separate housing 48A is equipped with a similar gasket. This way, the contents of the separate housing 48A remain free from environmental contamination.

The separate housing 48A preferably further includes warning labels which provide instructions regarding the recommended use and non-recommended use of the sound amplifying respirator. One such label, for example, would warn a user not to connect or disconnect the battery in an explosive environment.

Figure 6:
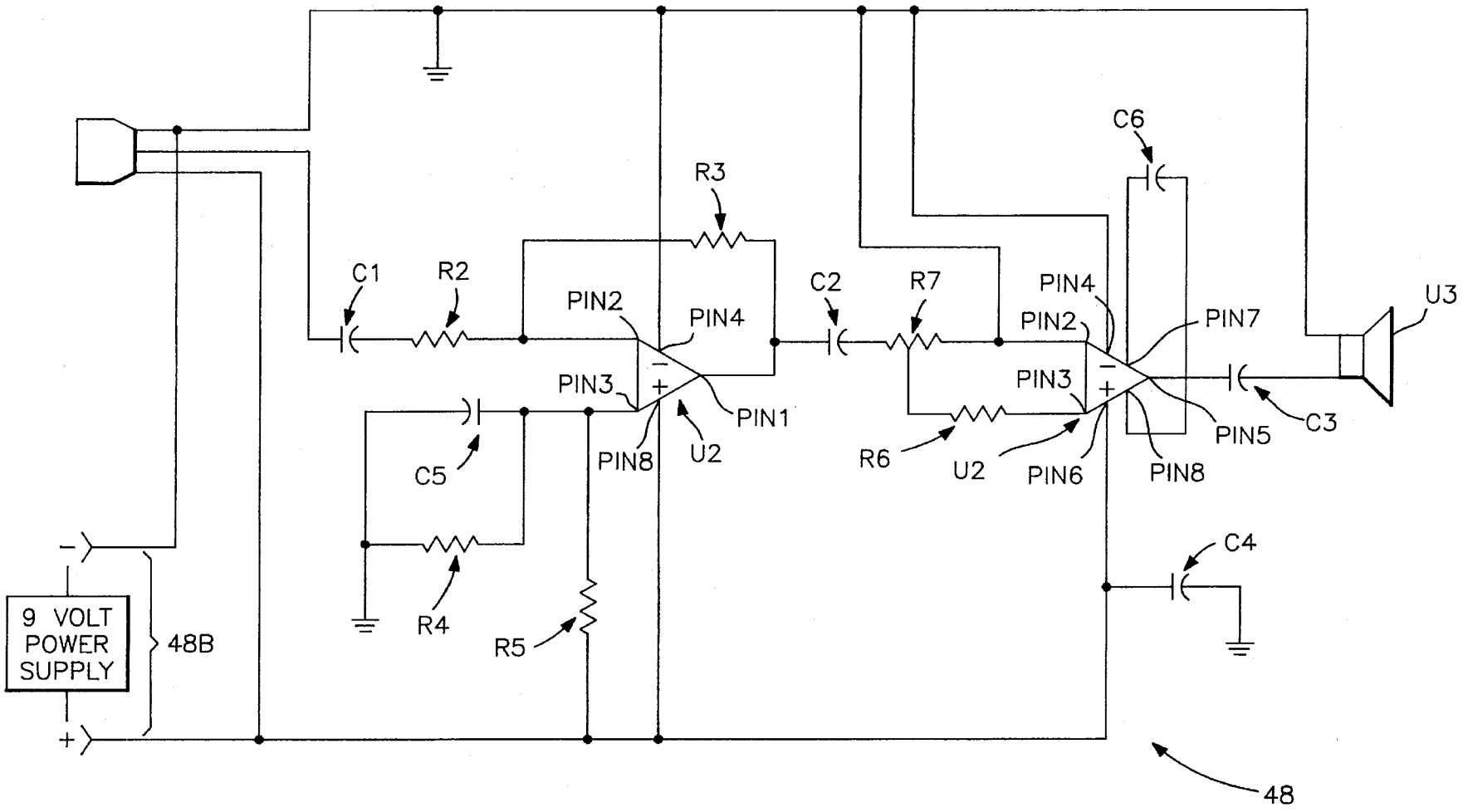
FIG. 6 is a circuit diagram of an amplification circuit 48 for the microphone mounting structure of the present invention.

Although a preferred amplification circuit 48 is illustrated in FIG. 6, it is well understood that many other amplifications circuits will suffice. In addition, the amplification circuit 48 can be modified, for example, to include a voice actuation circuit to thereby conserve battery power, as is generally known. The following table correlates the reference numeral for each element in amplification circuit 48, with the details thereof:

| REF. No. | DETAILS OF CIRCUIT ELEMENTS FROM AMPLIFICATION CIRCUIT 48 |
|---|---|
| 4 | ELECTRECT condenser microphone |
| C1 | Audio coupling using a 0.022 μfarad non-polarized film capacitor |
| C2 | Audio coupling using a 0.05 μfarad non-polarized film capacitor |
| C3 | Coupling power to speaker using a 47 μfarad polarized aluminum capacitor |

-continued

| REF. No. | DETAILS OF CIRCUIT ELEMENTS FROM AMPLIFICATION CIRCUIT 48 |
|---|---|
| C4 | Power supply filter capacitor having a 47 μfarad capacitance |
| C5 | Audio bypass capacitor which provides a 0.1 μfarad bias for the preamplifier U1 |
| C6 | Gain is increased to 200 using a 10 μfarad polarized aluminum capacitor |
| R2 | 1 KΩ input limiting resistor |
| R3 | 10 KΩ negative feedback resistor |
| R4 | 100 KΩ bias resistor to ground |
| R5 | 100 KΩ bias resistor to a positive power supply terminal |
| R6 | 270 Ω input limiting resistor |
| R7 | 10 KΩ potentiometer for providing volume control |
| U1 | 625 milliwatt preamplifier, an example of which is commercially available under part number IM1458 IC |
| U2 | 1 watt power amplifier, an example of which is commercially available under part number IM386N-1 IC |
| U3 | Speaker (preferably, 1 watt, and 2 inch diameter) |

A significant portion of the amplification circuit 48 is commercially available from MCM TechKit of Centerville, Ohio, and is listed under audio amplifier number AA-1. The amplifier circuit 48 illustrated in FIG. 6, however, includes several modifications which make the circuit 48 particularly well suited for amplification of voices in a respiratory mask. In particular, the capacitors C1, C2, C5 and C6 have been chosen so as to provide a frequency response highly conducive to amplifying the human voice from within a respiratory mask. Preferably, the low frequencies associated with breath sounds are attenuated, while the higher frequencies associated with the human voice are amplified.

The pin designations in FIG. 6 relate to the particular amplifier integrated chips listed in the above table. It is understood that such pin designations may be different depending on the particular amplifier chips used. In addition, as FIG. 6 indicates, the amplifier circuit 48 is particularly adapted to operate from a 9 volt power supply, and according to the preferred embodiment, from a conventional 9 volt battery.

The microphone mounting structure 2 can further include a circumferential flange 50 projecting radially out from the front end 34 of the tubular locking mechanism 14. The flange 50 advantageously provides a greater surface area squeezing the mask 6 between the tubular locking mechanism 14 and the large-diameter closed end 16 of the tubular plug 10. Preferably, the large-diameter closed end 16 of the tubular plug 10 and the circumferential flange 50, each have a projection 51 which is arranged so as to bite the mask 6. Each projection 51 is preferably coextensive with the flange 50 and the large-diameter closed end 16 of the tubular plug 10. This overall arrangement helps prevent stretching of the hole 8 in the mask 6 beyond the circumference of the mounting structure 2 and consequently prevents any undesirable leaks which might otherwise develop. The flange 50 therefore provides a more secure structural arrangement and a more reliable air-tight seal.

At least one resilient washer 52 is preferably disposed coaxially around the central portion 20 of the tubular plug 10, between the front end 34 of the tubular locking mechanism 14 and the closed end 16 of the tubular plug 10. The number of resilient washers 52 and their respective thicknesses depend primarily upon the resiliency and thickness of the mask 6 itself. Thick masks having a high resiliency typically need no washers 52, while thinner and less resilient masks may require one or more washers 52. The washers 52 are preferably made of neoprene rubber, or similar resilient materials which are capable of withstanding exposure to hostile environments.

According to a preferred arrangement, there are between six and eight fingers 22 in the tubular plug 10. Experiments with other numbers of fingers have yielded more brittle parts or an otherwise less effective locking arrangement. Nevertheless, such parts may be effective in limited applications of the microphone mounting structure 2, which applications would fall well within the scope and spirit of the present invention.

One and preferably all of the finger tips 26 project radially outwardly and backwardly toward the central portion 20 so that each of the corresponding resilient fingers 22 has a semi-arrow-shaped distal end. In addition, the tubular locking mechanism 14 includes an externally bevelled back end 54 for lockingly engaging the semi-arrow-shaped distal ends of the resilient fingers 22. This locking arrangement, once secured to the mask 6, advantageously prevents inadvertent loosening of the mounting structure 2.

A preferred method for securing the microphone mounting structure 2 to the respiratory mask 6 will now be described. Initially, the hole 8 is created at a desired mounting position on the mask 6. The hole 8 may be created in any known manner, including cutting and drilling, and is preferably made by pressing a sharp circular cutting element against a firm surface with the mask 6 sandwiched therebetween. The diameter of the sharp cutting element substantially matches the outside diameter of the central portion 20 of the tubular plug 10 so that the hole 8 will be of proper size.

Once the hole 8 has been created, the tubular plug 10 can be inserted into the hole 8, starting from outside of the mask 6 and penetrating the hole 8 toward the inside of the mask 6. It is understood that any resilient washers which are to remain on the outside of the mask 6, will be mounted circumferentially around the central portion 20 prior to insertion of the tubular plug 10 into the hole 8. Insertion of the tubular plug 10 continues until the closed end 16 of the tubular plug 10 abuts against the outside surface of the mask 6, or against a washer 52 disposed therebetween.

Next, any washers 52 which are to be mounted on an inside surface of the mask 6 are mounted circumferentially around the tubular plug 10 and then brought into contact with the inside surface of the mask 6. After the washers 52 are appropriately positioned, the tubular locking mechanism 14 is brought into axial alignment with the tubular plug 10 inside of the mask 6. This axial alignment is achieved such that the flange 50 faces the tubular plug 10. With the flange 50 facing the tubular plug 10, the locking mechanism 14 is brought against the finger tips 26 and then pressed toward the mask 6. This pressing action causes a radially inward displacement of the resilient fingers 22 which permits the tubular locking mechanism 14 to pass over the central portion 20 of the tubular plug 10 and into contact with the mask 6, or alternatively, into contact with a washer 52 disposed against the inside surface of the mask 6.

The tubular locking mechanism is then pressed harder against the mask 6 to cause compression of the mask 6 and/or resilient washers 52. Such compression permits the externally bevelled back end 54 of the locking mechanism 14 to pass beyond the finger tips 26 thus releasing the finger tips 26. Once released, the resilient fingers 22 snap outwardly so that the finger tips 26 lockingly engage the bevelled back end 54 of the tubular locking mechanism 14. This locking arrangement is securely maintained by the cooperating shapes of the finger tips 26 and the externally bevelled back end 54, combined with the back pressure exerted by the mask 6 and/or washers 52 by virtue of their compressed state. It is noted that, upon locking the foregoing elements as indicated above, the air-tight characteristic of the respiratory mask 6 is re-established.

This air-tight characteristic can be tested in non-filter masks by placing the mask over one's face, holding closed any air hoses to the mask 6, and subsequently inhaling. Confirmation of the air-tight characteristics will be evidenced by the ability to suck the mask into one's face. Likewise, the finger tips 26 of the resilient fingers 22 always remain exposed for visual verification of the locking arrangement.

Next, the microphone 4 is inserted into the sleeve 12 so that the sleeve 12 frictionally retains the microphone 4. The wires 38 are preferably pre-connected to respective ones of the electrical contacts 36; however, it is understood that a separate connector can be provided for making connections in the field. The microphone cover 32 is then mounted to the projecting sleeve portion 30.

Thereafter, the sleeve 12 is axially aligned with the tubular plug 10 inside the mask 6, and is rotationally positioned so that the external alignment tab 42 aligns with the internal alignment slot 40 of the tubular plug 10. Once the tab 42 and slot 40 are properly aligned, the sleeve 12 is forced into the open end 18 of the tubular plug 10 and driven therein until only the projecting sleeve portion 30 remains exposed. At this point, the sleeve 12 and the microphone 4 are frictionally retained inside the tubular plug 10, with the electrical contacts 36 engaging the electrical contact means 28 of the tubular plug 10. In this position, the sleeve 12 prevents the resilient fingers 22 from bending radially inwardly. This advantageously provides added security against inadvertent release of the tubular locking mechanism 14.

The microphone 4 is thus securely mounted to the mounting respiratory mask 6. Thereafter, the microphone 4 can be electrically connected to the amplification circuit 48 by connecting the electrical plug 46 to the socket 44 of the tubular plug 10.

A particularly advantageous feature of the microphone mounting structure 2 is the ability to remove the combination of the microphone 4 and sleeve 12, while leaving the tubular plug 10 and the tubular locking mechanism 14 mounted to the mask 6. When the mask 6 is then washed, for example, the projecting sleeve portion 30 may be gripped using any suitable means and pulled to remove the combination of the sleeve 12, microphone 4, and microphone cover 32 out from the tubular plug 10 as a unit. Thereafter, the mask 6 can be washed without fear of damaging the microphone 4.

In the preferred structure, according to the present invention, the elements which seal the hole 8 (i.e., the tubular plug 10, tubular locking mechanism 14, and washers 52) remain attached to the mask 6, while the microphone 4 and sleeve 12 are readily removable. Further, once the seal is established by the former elements, there is no need to again break this seal to remove the microphone 4. This advantageously prevents repetitious wearing of the critical elements that establish and maintain the mask's seal. An enhanced level of safety is thereby provided.

While the present invention has been described with reference to the above preferred embodiments and drawings, it is understood that the invention is not limited to these embodiments. For example, numerous variations of, and modifications to, the above embodiments will become subsequently apparent, which variations and modifications fall well within the scope and spirit of the present invention. Accordingly, it is understood that the present invention is limited only by the scope of the appended claims.

We claim:

1. A microphone mounting structure for mounting a microphone to a respiratory mask through a hole in the respiratory mask, said microphone mounting structure comprising:

a tubular plug having a closed end, an open end and a central portion disposed therebetween, said closed end having a larger outer diameter than an outer diameter of the central portion, said open end having a plurality of resilient fingers defined by slots in said open end of the tubular plug, said resilient fingers having finger tips which project radially outwardly with respect to the tubular plug, said tubular plug having electrical contact means for electrically connecting an interior of said tubular plug with an exterior of said tubular plug;

a sleeve for receiving said microphone, said sleeve having an outer diameter substantially equal to an inner diameter of said tubular plug so that said sleeve fits coaxially inside said tubular plug; and a tubular locking mechanism having an inner diameter substantially equal to the outer diameter of said central portion and a longitudinal length slightly shorter than a combination of said central portion and said open end, said tubular locking mechanism being slidable over said resilient fingers after said tubular plug is inserted through said hole to thereby force said resilient fingers radially inwardly until the entire tubular locking mechanism has passed over the fingers tips of the resilient fingers at which time the finger tips snap radially outwardly to thereby lock said microphone mounting structure to the respiratory mask, the respiratory mask being locked between a front end of said tubular locking mechanism and the closed end of the tubular plug.

2. The microphone mounting structure of claim 1, further comprising:

a set of electrical contacts extending radially through the sleeve, said set of electrical contacts being arranged for electrical connection to said electrical contact means in said tubular plug.

3. The microphone mounting structure of claim 2, further comprising electrical wires for electrically connecting said set of electrical contacts to said microphone.

4. The microphone mounting structure of claim 2, further comprising:

an internal alignment slot extending longitudinally along said central portion and said open end of the tubular plug; and an external alignment tab which projects radially outwardly from said sleeve for alignment with the internal alignment slot of the tubular plug, said external alignment tab being arranged so as to prevent axial rotation of said sleeve with respect to said tubular plug whenever said external alignment tab is received in said internal alignment slot.

5. The microphone mounting structure of claim 1, further comprising a socket at the closed end of said tubular plug, for receiving an electrical plug which electrically connects said electrical contact means to an amplification circuit.

6. The microphone mounting structure of claim 1, further comprising a circumferential flange projecting radially outwardly from said front end of the tubular locking mechanism.

7. The microphone mounting structure of claim 1, further comprising at least one resilient washer for placement coaxially around said central portion between the front end of the tubular locking mechanism and the closed end of the tubular plug.

8. The microphone mounting structure of claim 1, wherein said sleeve is longer than the central portion and open end of the tubular plug so that said sleeve includes a sleeve portion which projects outwardly from said tubular plug to facilitate removal of said sleeve from within said tubular plug.

9. The microphone mounting structure of claim 8, further comprising a microphone cover which fits snugly over said sleeve portion.

10. The microphone mounting structure of claim 1, wherein at least one of said finger tips projects radially outwardly and backwardly toward said central portion so that a corresponding at least one of said resilient fingers has a semi-arrow-shaped distal end.

11. The microphone mounting structure of claim 10, wherein said tubular locking mechanism includes an externally bevelled back end for lockingly engaging said semi-arrow-shaped distal end of said at least one of said resilient fingers.

12. The microphone mounting structure of claim 1, wherein said finger tips project radially outwardly and backwardly toward said central portion so that each of said resilient fingers has a semi-arrow-shaped distal end.

13. The microphone mounting structure of claim 12, wherein said tubular locking mechanism includes an externally bevelled back end for lockingly engaging said semi-arrow-shaped distal end of each of said resilient fingers.

14. The microphone mounting structure of claim 1, wherein said sleeve has an internal diameter which matches an outer diameter of said microphone so that said microphone is frictionally retained within said sleeve.

15. A sound-amplifying respiratory mask which comprises:

a conventional respiratory mask having a separate hole formed therein;

a tubular plug for insertion through said hole, said tubular plug having a closed end, an open end and a central portion disposed therebetween, said closed end having a larger outer diameter than an outer diameter of the central portion, said open end having a plurality of resilient fingers defined by slots in said open end of the tubular plug, said resilient fingers having finger tips which project radially outwardly with respect to the tubular plug, said tubular plug having electrical contact means for electrically connecting an interior of said tubular plug with an exterior of said tubular plug;

a sleeve for receiving said microphone, said sleeve having an outer diameter substantially equal to an inner diameter of said tubular plug so that said sleeve fits coaxially inside said tubular plug; and a tubular locking mechanism having an inner diameter substantially equal to the outer diameter of said central portion and a longitudinal length slightly shorter than a combination of said central portion and said open end, said tubular locking mechanism being slidable over said resilient fingers after said tubular plug is inserted through said hole to thereby force said resilient fingers radially inwardly until the entire tubular locking mechanism has passed over the fingers tips of the resilient fingers at which time the finger tips snap radially outwardly to thereby lock said tubular plug and said tubular locking mechanism to the respiratory mask, the respiratory mask being locked between a front end of said tubular locking mechanism and the closed end of the tubular plug.

16. The microphone mounting structure of claim 15, further comprising:

a set of electrical contacts extending radially through the sleeve, said set of electrical contacts being arranged for electrical connection to said electrical contact means in said tubular plug.

17. The microphone mounting structure of claim 16, further comprising electrical wires for electrically connecting said set of electrical contacts to said microphone.

18. The microphone mounting structure of claim 15, further comprising a circumferential flange projecting radially outwardly from said front end of the tubular locking mechanism.

19. The microphone mounting structure of claim 15, wherein at least one of said finger tips projects radially outwardly and backwardly toward said central portion so that a corresponding at least one of said resilient fingers has a semi-arrow-shaped distal end.

20. A microphone mounting structure for converting a respiratory mask into a sound amplifying respiratory mask, said microphone mounting structure comprising:

a tubular plug for insertion through a hole in the respiratory mask, said tubular plug having a closed end, an open end and a central portion disposed therebetween, said closed end having a larger outer diameter than an outer diameter of the central portion, said open end having a plurality of resilient fingers defined by slots in said open end of the tubular plug, said resilient fingers having finger tips which project radially outwardly with respect to the tubular plug, said tubular plug having electrical contact means for electrically connecting an interior of said tubular plug with an exterior of said tubular plug;

a microphone responsive to oral sounds within the respiratory mask, for producing electrical signals indicative of said oral sounds, said microphone being electrically connected to said electrical contact means so that said electrical signals are provided to said electrical contact means;

amplification circuitry electrically connected to said electrical contact means for receiving said electrical signals and producing output sounds representative of said oral sounds;

a sleeve containing said microphone, said sleeve having an outer diameter substantially equal to an inner diameter of said tubular plug so that said sleeve fits coaxially inside said tubular plug;

a tubular locking mechanism having an inner diameter substantially equal to the outer diameter of said central portion and a longitudinal length slightly shorter than a combination of said central portion and said open end, said tubular locking mechanism being slidable over said resilient fingers after said tubular plug is inserted through said hole to thereby force said resilient fingers radially inwardly until the entire tubular locking mechanism has passed over the fingers tips of the resilient fingers at which time the finger tips snap radially outwardly to thereby lock said microphone mounting structure to the respiratory mask, the respiratory mask being locked between a front end of said tubular locking mechanism and the closed end of the tubular plug.

* * * * *